US008127397B2

(12) United States Patent
Hess et al.

(10) Patent No.: US 8,127,397 B2
(45) Date of Patent: Mar. 6, 2012

(54) VACUUM CLEANER

(75) Inventors: Stefan Hess, Leutenbach (DE); Martin Foell, Winnenden (DE); Andreas Kramer, Erdmannhausen (DE); Andreas Renz, Leutenbach (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/924,623

(22) Filed: Sep. 29, 2010

(65) Prior Publication Data

US 2011/0088201 A1 Apr. 21, 2011

Related U.S. Application Data

(63) Continuation of application No. PCT/EP2009/003098, filed on Apr. 29, 2009.

(51) Int. Cl.
*A47L 5/00* (2006.01)

(52) U.S. Cl. ..... 15/323; 15/327.2

(58) Field of Classification Search ..... 15/323, 15/327.2; *A47L 5/00*
See application file for complete search history.

(56) References Cited

U.S. PATENT DOCUMENTS

| | | | | |
|---|---|---|---|---|
| 2,233,167 | A | 2/1941 | Holm-Hansen | |
| 3,166,777 | A * | 1/1965 | Frantz | 15/323 |
| 3,480,987 | A | 12/1969 | Schaefer | |
| 4,715,083 | A * | 12/1987 | Harris et al. | 15/323 |
| 5,233,722 | A * | 8/1993 | McKnight et al. | 15/323 |
| 6,419,169 | B1 | 7/2002 | Rennecker et al. | |
| 7,480,959 | B2 | 1/2009 | Bott et al. | |
| 2005/0198764 | A1 | 9/2005 | Heatley | |
| 2006/0156506 | A1 | 7/2006 | Bott et al. | |

FOREIGN PATENT DOCUMENTS

| | | |
|---|---|---|
| DE | 1 948 941 | 5/1970 |
| DE | 102 60 226 | 7/2004 |
| DE | 20 2004 009 785 | 8/2004 |
| DE | 20 2005 002 979 | 4/2005 |
| DE | 20 2004 005 818 | 8/2005 |
| EP | 1 922 969 | 5/2008 |

* cited by examiner

*Primary Examiner* — David Redding
(74) *Attorney, Agent, or Firm* — Lipsitz & McAllister, LLC

(57) ABSTRACT

The invention relates to a vacuum cleaner comprising a lower housing part, on which wheels are mounted for moving the vacuum cleaner along a floor surface, and which forms a dirt collection container with a suction inlet to which a suction hose is connectable, and an upper housing part which is mountable on the lower housing part and accommodates an electrically drivable suction unit, and an electric supply cable for connecting the suction unit to an electrical voltage source. In order to develop the vacuum cleaner so that it is easier to handle, and the supply cable and the suction hose can be held in a simple way for storage on the vacuum cleaner and removed from the vacuum cleaner for use, it is proposed, in accordance with the invention, that the vacuum cleaner have a cable receptacle for storing the supply cable and a hose mount for storing the suction hose, the cable receptacle surrounding the upper housing part on the outside in the circumferential direction, and the hose mount being arranged below the cable receptacle.

13 Claims, 4 Drawing Sheets

VACUUM CLEANER

This application is a continuation of international application number PCT/EP2009/003098 filed on Apr. 29, 2009 and claims the benefit of German application number 10 2008 022 321.2 filed on Apr. 30, 2008.

The present disclosure relates to the subject matter disclosed in international application number PCT/EP2009/003098 of Apr. 29, 2009 and German application number 10 2008 022 321.2 of Apr. 30, 2008, which are incorporated herein by reference in their entirety and for all purposes.

BACKGROUND OF THE INVENTION

The invention relates to a vacuum cleaner comprising a lower housing part, on which wheels are mounted for moving the vacuum cleaner along a floor surface, and which forms a dirt collection container with a suction inlet to which a suction hose is connectable, and an upper housing part which is mountable on the lower housing part and accommodates an electrically drivable suction unit, and an electric supply cable for connecting the suction unit to an electrical voltage source.

A floor surface, for example, or a piece of furniture, in particular, upholstered furniture, can be vacuumed with such vacuum cleaners. The vacuum cleaner can be moved along the floor surface by the user. To this end, wheels are mounted on the lower housing part, for example, two running wheels and at least one steering wheel pivotable about a vertical pivot axis. The suction unit arranged in the upper housing part, which comprises an electric motor and a suction turbine, generates a negative pressure in the dirt collection container formed by the lower housing part, so that dirt particles can be sucked into the dirt collection container via the suction hose which can be connected to the suction inlet. An electric supply cable is used to supply the suction unit with electrical energy.

The electric supply cable can have a length of more than 10 meters, for example, a length of 15 meters, and the suction hose usually also has a considerable length, for example, a length of at least two meters. For storage of the vacuum cleaner, the supply cable is usually wound up and held on the vacuum cleaner. It is, in addition, helpful if the suction hose can also be secured to the housing of the vacuum cleaner. When the vacuum cleaner is subsequently put into operation again, it is often awkward for the user to transfer the supply cable and the suction hose independently of each other into a position of use. There is often a risk of supply cable and suction hose becoming entangled and thus making it difficult to put the vacuum cleaner into use.

The object of the present invention is to develop a vacuum cleaner of the generic kind so that it is easier to handle, and the supply cable and the suction hose can be held in a simple way for storage on the vacuum cleaner and removed from the vacuum cleaner for use.

SUMMARY OF THE INVENTION

This object is accomplished, in accordance with the invention, in a vacuum cleaner of the kind mentioned at the outset in that the vacuum cleaner has a cable receptacle for storing the supply cable and a hose mount for storing the suction hose, the cable receptacle surrounding the upper housing part on the outside in the circumferential direction, and the hose mount being arranged below the cable receptacle.

In the vacuum cleaner in accordance with the invention, the supply cable can be easily positioned on the upper housing part for storage by being wound around the outer side of the upper housing part. To this end, the upper housing part has a cable receptacle which, owing to its position on the upper housing part, is easily accessible to the user. If the vacuum cleaner is to be put into operation, the supply cable can be readily wound off in the desired length from the upper housing part by the user.

Also the suction hose which is connectable to the suction inlet can be easily positioned for storage on the vacuum cleaner. To this end, a hose mount is used, which is arranged below the cable receptacle. This has the advantage that the suction hose can be positioned below the supply cable on the vacuum cleaner, so that supply cable and suction hose can be arranged independently of each other for storage on the vacuum cleaner without there being any risk of them becoming entangled. Preferably, the suction hose can be clamped into the hose mount. If the vacuum cleaner is to be put into operation, the suction hose can be removed from the hose mount without impeding removal of the supply cable from the cable receptacle. The vacuum cleaner in accordance with the invention is therefore distinguished by easier handling.

It is expedient for the cable receptacle to be of channel-shaped configuration and to have an opening for passing through an end area of the supply cable into the interior of the upper housing part. A strain relief may be arranged at the opening. Starting from the suction unit or a control device associated with the suction unit, the supply cable can first extend within the upper housing part, to then exit from the upper housing part through the opening arranged in the cable receptacle. Outside the upper housing part, the supply cable can be positioned in the channel-shaped cable receptacle for storage.

The hose mount is preferably secured to the outer side of the lower housing part. This has the advantage that the upper housing part can be lifted off the lower housing part without the suction hose having to be previously removed from the hose mount.

It has proven particularly expedient for the hose mount to be secured to the side of the lower housing part that faces away from the suction inlet.

In a preferred embodiment of the vacuum cleaner in accordance with the invention, the hose mount is arranged at a greater distance from the floor surface than the suction inlet. This facilitates the positioning of the suction hose in the hose mount, with an end of the suction hose being simultaneously connected to the suction inlet.

The hose mount expediently comprises at least one L-shaped hook. It is particularly advantageous for the hose mount to comprise two L-shaped hooks, which are arranged at a distance from each other. The suction hose can be easily clamped or hung on the at least one hook for storage.

It may be provided that the two hooks are aligned parallel to each other.

It is advantageous for the hose mount to comprise two hooks which each have a first leg which projects from the lower housing part and has an adjoining second leg extending up to the level of and at a distance from the upper housing part. The first legs of the hooks can be secured to the lower housing part, and the second legs can project upwards, in the operating position of the vacuum cleaner, in the direction facing away from the floor surface, with the free ends of the second legs arranged laterally next to and at a distance from the upper housing part. The suction hose can then be easily inserted into the area between the second legs and the upper housing part, with it being supported on the underside by the first legs of the hooks.

The two hooks of the hose mount are preferably rigidly connected to each other by a cross member. This increases the mechanical stability of the hose mount.

In an advantageous embodiment of the vacuum cleaner, the cross member forms a supporting surface for supporting the suction hose. This has the advantage that the suction hose is not only supported by the first legs of the hooks in the vertical direction, but is additionally supported by the cross member, which connects the two hooks to each other.

It is expedient for the cross member and the two hooks to be formed in one piece from a plastic molding.

As mentioned at the outset, the vacuum cleaner can be moved along a floor surface by means of the wheels arranged on the lower housing part. If the vacuum cleaner is positioned on the loading platform of a transportation vehicle for transport to an object to be cleaned, for example, for the journey to a building site, there is a risk that the vacuum cleaner will unintentionally start to move during transport. In a particularly preferred embodiment of the vacuum cleaner in accordance with the invention, it is, therefore, provided that the hose mount has on its outer side facing away from the upper housing part at least one set-down surface for setting the vacuum cleaner down on a floor surface in a storage position tilted through 90° in relation to the operating position of the vacuum cleaner. In its operating position, the wheels arranged on the lower housing part are in contact with the floor surface, so that the vacuum cleaner can be moved. For storage, the vacuum cleaner can be tilted through 90°. It is thereby seated with the at least one set-down surface, preferably with two set-down surfaces, spaced from each other, of the hose mount on the floor surface. In this position, the vacuum cleaner cannot be moved by means of the wheels, which eliminates the risk of it slipping accidentally during transport.

It may, for example, be provided that the hose mount comprises two L-shaped legs. This has been explained hereinabove. In this connection, it is expedient for the second legs to each form in the area of their free ends facing away from the upper housing part a set-down surface for setting the vacuum cleaner down on a floor surface. In an advantageous embodiment, at least one further set-down surface is arranged on the lower housing part.

One end of the suction hose can, as usual, be connected to the suction inlet, and a suction pipe which carries a suction nozzle at its free end for vacuuming a surface can be connected in the usual way to the other end of the suction hose. For example, a floor nozzle can be attached to the free end of the suction pipe. It is expedient if, alternatively to the floor nozzle, for example, a crevice nozzle, an upholstery nozzle or a radiator brush can be attached. Such accessory parts of the vacuum cleaner are used for cleaning special surfaces. The accessory parts can be arranged for storage on the vacuum cleaner. To this end, there is provided in a particularly preferred embodiment of the invention that at least one recess is arranged below the hose mount for storing at least one accessory part of the vacuum cleaner. The least one accessory part can preferably be clamped in the recess. The positioning of the recess below the hose mount leads to a further simplification of the handling of the vacuum cleaner as neither the suction hose nor the supply cable interferes with removal of an accessory part from or insertion of an accessory part into the recess.

The at least one recess is expediently formed in a plastic molding which is arranged on the outer side of the lower housing part. The lower housing part may therefore have a shape adapted solely to the optimum functioning of the dirt collection container. In particular, it may be provided that the dirt collection container has as smooth a surface as possible on the inside so that it can be easily cleaned. The design of the lower housing part is not affected by the provision of at least one recess which is used for storing at least one accessory part. On the contrary, a separate plastic molding which can be attached to the outside of the lower housing part is provided for the recess. The plastic molding may be non-releasably connected to the lower housing part, for example, latched to it. It may, however, also be provided that the plastic molding is connected by a releasable connection, for example, by a screw connection, to the lower housing part.

It is particularly advantageous for the plastic molding to form the at least one recess and also the hose mount. This facilitates assembly of the vacuum cleaner and also reduces its manufacturing costs. The hose mount and the at least one recess together form a one-piece plastic molding which can be attached to the side of the lower housing part. In particular, it may be provided that the plastic molding has several recesses, for example, recesses for insertion of a crevice nozzle, an upholstery nozzle and also a radiator brush. These accessory parts are easily accessible to the user below the hose mount. In particular, it may be provided that the accessory parts arranged in the at least one recess are directly accessible to the user without a flap or some other cover covering the accessory parts.

It is particularly advantageous for the vacuum cleaner to comprise a first and a second holding device for a floor nozzle which is connected to the suction hose, the first holding device being arranged on a side wall of the lower housing part and the second holding device on a bottom wall of the lower housing part. As explained hereinabove, it is expedient for the vacuum cleaner to be adapted not only to be moved with its wheels along a floor surface in an operating position but also to be set down in a storage position tilted through 90° in relation to the operating position of the vacuum cleaner. In this storage position, the second holding device positioned on the bottom wall of the lower housing part is accessible to the user so that he can secure the floor nozzle to the second holding device. Alternatively, in the operating position of the vacuum cleaner, the user can secure the floor nozzle on the first holding device which is positioned at the side of the lower housing part. If, for example, a cleaning operation is only briefly interrupted, the first holding device arranged at the side of the lower housing part can then accommodate the floor nozzle. If, on the other hand, the vacuum cleaner is put out of operation for a longer period of time, it can be tilted through 90° into a storage position, and the floor nozzle can then be secured on the second holding device.

The following description of a preferred embodiment of the invention serves in conjunction with the drawings for further explanation.

DETAILED DESCRIPTION OF THE INVENTION

Figure 1:
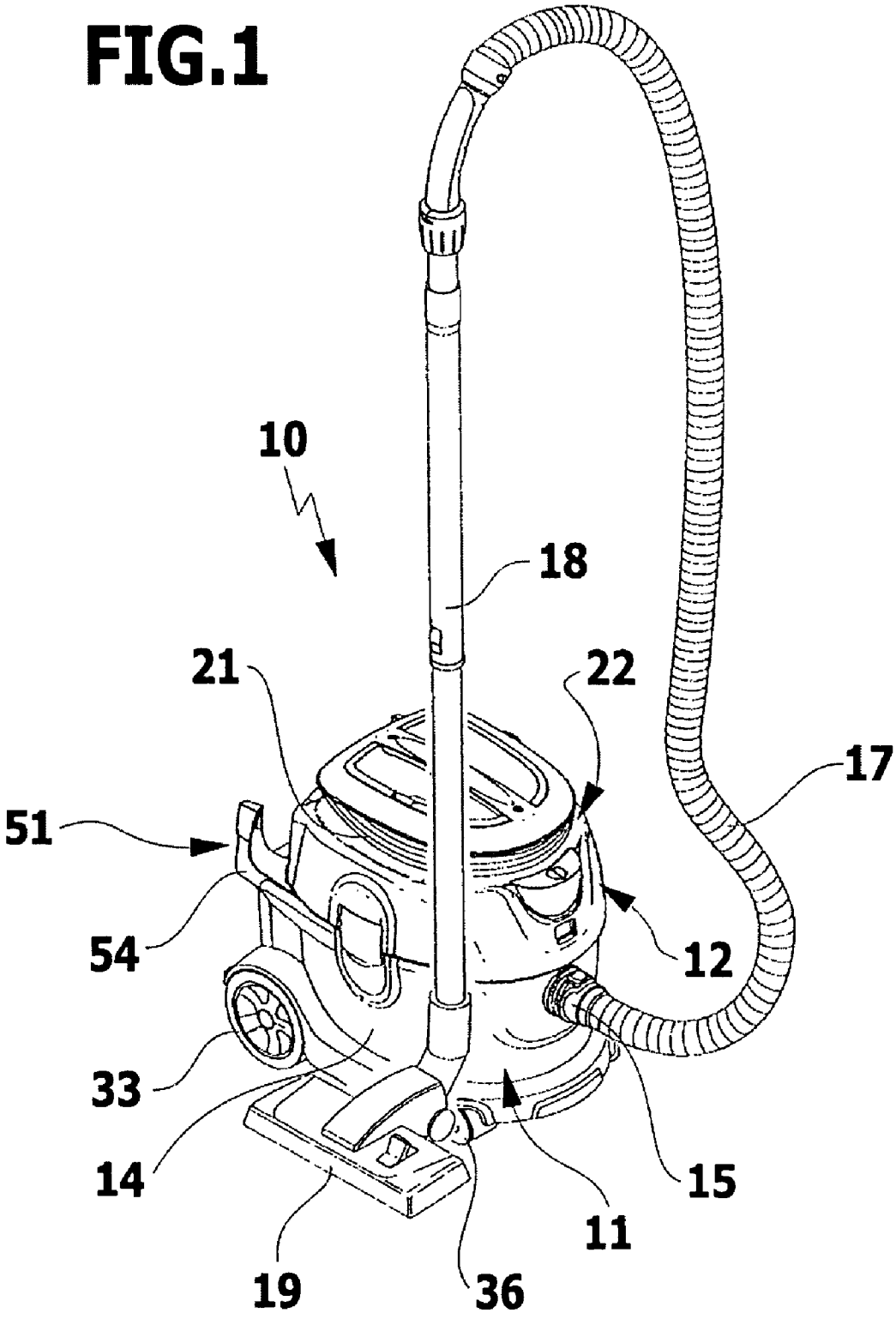
FIG. 1 a perspective representation of a vacuum cleaner with suction hose, suction pipe and floor nozzle.
Figure 2:
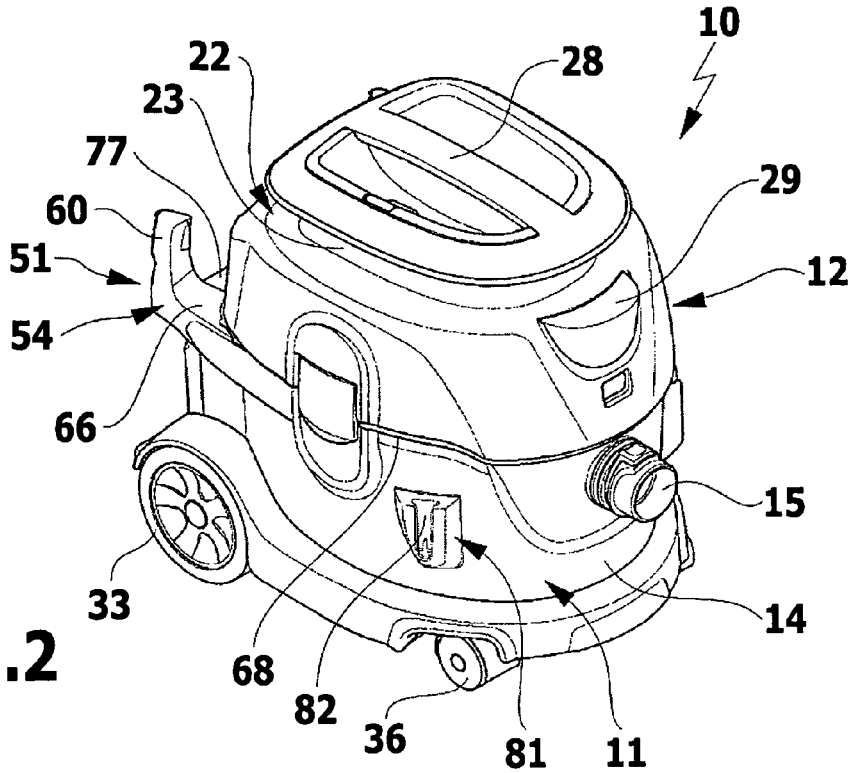
FIG. 2 a perspective representation of the vacuum cleaner illustrated in FIG. 1.

The drawings show diagrammatically a vacuum cleaner 10 in accordance with the invention with a lower housing part 11 and an upper housing part 12 mountable on the lower housing part 11. The lower housing part 11 forms a dirt collection container 14 with a suction inlet 15, which is in the form of a pipe connection and to which a suction hose 17 can be connected. In the embodiment shown in FIG. 1, a telescopic suction pipe 18 is connected to the free end of the suction hose 17. The suction pipe 18 carries at its free end a floor nozzle 19 for vacuuming a floor surface.

The upper housing part 12 accommodates in the usual way, which is, therefore, not shown in the drawings, a suction unit with a suction turbine which is driven by an electric motor. The dirt collection container 14 can be subjected to negative pressure in the usual way by the suction unit, so that dirt particles can be drawn into the dirt collection container 14 via the floor nozzle 19, the suction pipe 18 and the suction hose 17.

Figure 3:
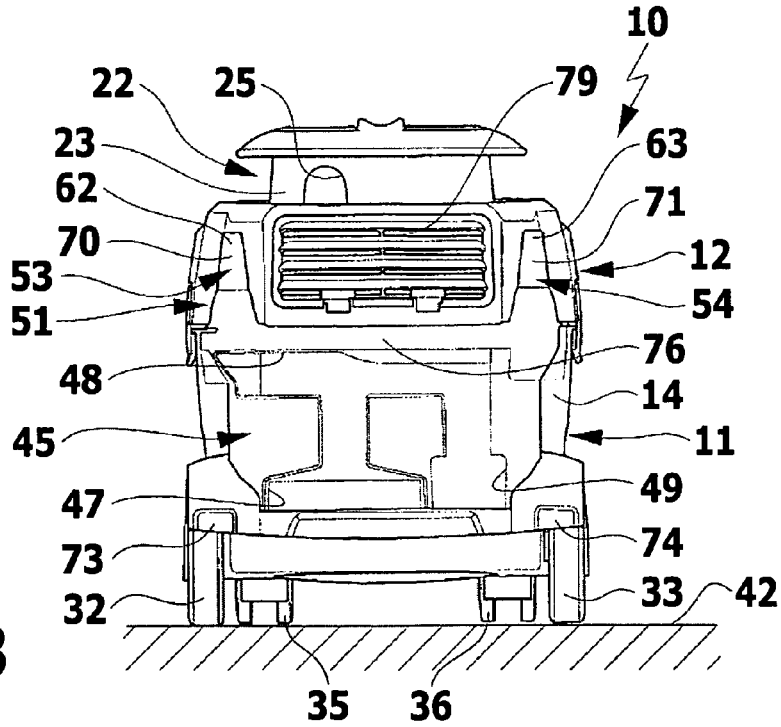
FIG. 3 a rear view of the vacuum cleaner from FIG. 1.
Figure 4:
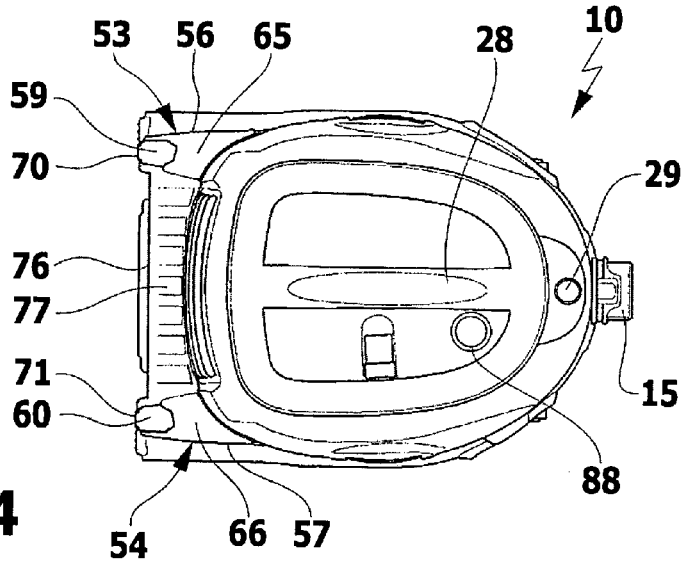
FIG. 4 a plan view of the vacuum cleaner from FIG. 1.

For connection of the suction unit to an electrical voltage source, the vacuum cleaner 10 comprises an electric supply cable 21 which, for storage of the vacuum cleaner 10, can be placed in a cable receptacle 22 which, in the form of a channel 23, surrounds the upper housing part 12 in the circumferential direction. The channel 23 has an opening 25. This will be apparent from FIG. 3. Via the opening, an end portion of the supply cable 21 can be inserted into the interior of the upper housing part 12, so that the supply cable 21 can be connected to control electronics of the vacuum cleaner 10. A strain relief can be fixed in the area of the opening 25.

On its upper side, the upper housing part 12 has a hand grip 28 which can be gripped by the user in order to carry the vacuum cleaner 10. At the side, the upper housing part 12 has above the suction inlet 15 a foot-operated switch 29, in the form of a pushbutton, for switching on and off the suction unit not shown in the drawings.

Two running wheels 32, 33 are mounted on the lower housing part 11 so as to be freely rotatable about a common axis of rotation 31. Also mounted on the lower housing part 11 are two steering wheels 35, 36, which are each freely rotatable about an axis of rotation 37 and 38, respectively, and, in addition, are pivotable about a vertical pivot axis 39 and 40, respectively. The vacuum cleaner 10 can be moved along a floor surface 42 by means of the running wheels 32, 33 and the steering wheels 35, 36. At the rear side of the lower housing part 11 that faces away from the suction inlet 15, a one-piece plastic molding 45 is secured to the lower housing part 11 above the running wheels 32, 33. The plastic molding 45 forms three recesses 47, 48, 49, into each of which an accessory part in the form of a crevice nozzle, an upholstery nozzle and a radiator brush can be inserted. As a person skilled in the art is familiar with such accessory parts, these are not shown in the drawings. Above the recesses 47, 48, 49, the plastic molding 45 forms a hose mount 51 for storing the suction hose 17 when the vacuum cleaner 10 is out of operation. The hose mount 51 comprises a first L-shaped hook 53 and a second L-shaped hook 54, which are aligned parallel to each other and each comprise a first leg 56 and 57, respectively, which protrudes from the rear side of the lower housing part 11, and a second leg 59 and 60, respectively, which adjoins the end of the first leg 56 and 57, respectively, and is aligned vertically in the direction facing away from the floor surface 42. The free end areas 62, 63 of the second legs 59 and 60, respectively, extend in the vertical direction up to the level of the upper housing part 12.

The two hooks 53, 54 each form a receptacle for the suction hose 17. The suction hose 17 can be secured at one end to the suction inlet 15 and then led around the outside of the vacuum cleaner 10 in order to be inserted into the area between the second legs 59 and 60 and the upper housing part 12. The first legs 56 and 57 then support the suction hose 17 in the vertical direction. To this end, the first legs 56 and 57 each form a supporting surface 65 and 66, respectively, which, in the operating position of the vacuum cleaner 10, is aligned substantially horizontally. The supporting surfaces 65 and 66 are arranged at the level of a partition line 68 extending between the lower housing part 11 and the upper housing part 12.

Figure 5:
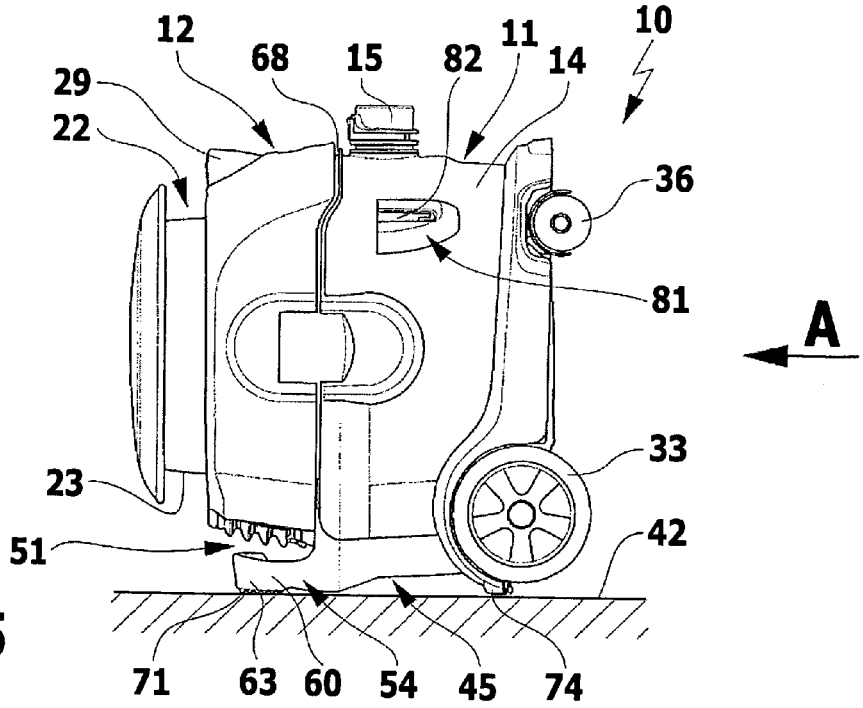
FIG. 5 a side view of the vacuum cleaner from FIG. 1, in which the vacuum cleaner assumes a storage position tilted through 90° in relation to the operating position.
Figure 6:
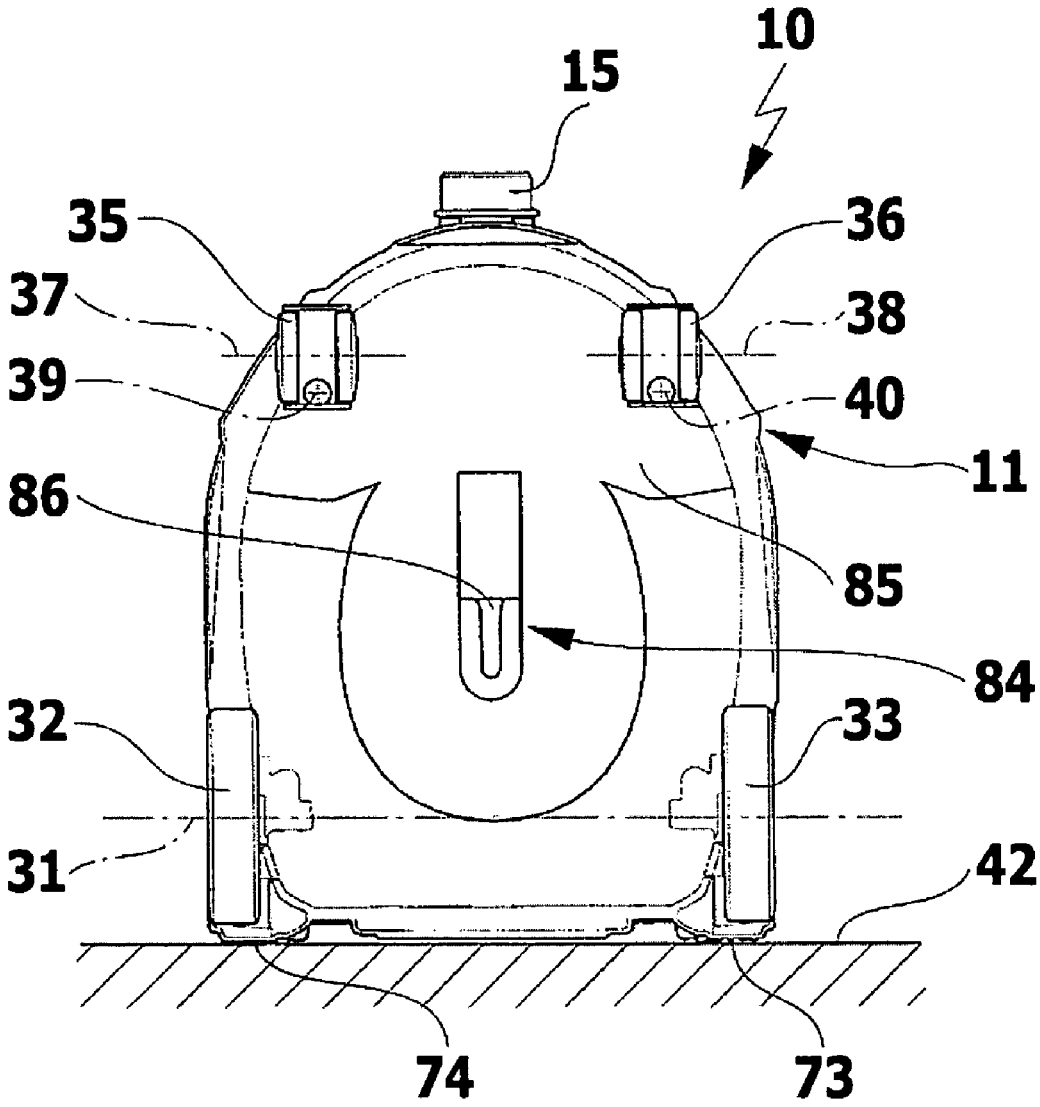
FIG. 6 a view of the vacuum cleaner from FIG. 5 in the direction of arrow A.

In their free end areas 62 and 63, respectively, the two legs 59 and 60 each form on their side facing away from the upper housing part 12 a set-down surface 70 and 71, respectively. To this end, the second legs 59 and 60 may each have a rib structure in their free end areas 62 and 63, respectively. The lower housing part 11 defines two further set-down surfaces 73 and 74 behind the running wheels 32 and 33, respectively. In a storage position, as shown in FIGS. 5 and 6, tilted through 90° in relation to the operating position shown in FIGS. 1 to 4, the vacuum cleaner 10 can be set down on the set-down surfaces 70, 71, 73 and 74 on the floor surface 42. This will be apparent, in particular, from FIG. 5. In the storage position of the vacuum cleaner 10, it rests on the set-down surfaces 70, 71, 73 and 74, and the running wheels 32, 33 and the steering wheels 35, 36 are at a distance from the floor surface 42. The vacuum cleaner 10 cannot be moved in the storage position. The vacuum cleaner can assume this storage position, in particular, during transport, and it is then ensured that it will not move accidentally, as might be the case while in its operating position.

The two hooks 53, 54 of the hose mount 51 are rigidly connected to each other by a cross member 76 which is also formed by the plastic molding 45.

The cross member 76 formed in the manner of a step defines on its upper side a further supporting surface 77 for the suction hose 17 and covers, in the operating position of the vacuum cleaner 10, the recesses 47, 48, 49 arranged below the cross member 76.

Between the two hooks 53 and 54, a grating 79 which covers an exhaust opening of the vacuum cleaner 10 is arranged on the upper housing part 12. After the air drawn in by the suction unit has passed through a filter positioned behind the grating 79 it is discharged through the exhaust opening to the outside.

The lower housing part 11 has on its outer side a first holding device 81 with a T-shaped groove 82 into which the floor nozzle 19 is insertable for storage with a holding rib, not shown in the drawings, which is of complementary construction to the T-shaped groove 82. A second holding device 84 is arranged on the underside 85 of the lower housing part 11. The second holding device 84 is identical in construction to the first holding device 81 and also has a T-shaped groove 86 into which the corresponding holding rib of the floor nozzle 19 is insertable for storage. This allows the user to secure the floor nozzle in the first holding device 81, as shown in FIG. 1, during a short interruption of a cleaning operation. Here the vacuum cleaner 10 assumes its operating position in which it can be moved along the floor surface 42 by means of the running wheels 32, 33 and the steering wheels 35, 36. If the vacuum cleaner 10 is to be put out of operation for a longer period of time, for example, during transport to a cleaning place, then the vacuum cleaner 10 can be tilted into the storage position in which the second holding device 84 is accessible to the user, so that he can secure the floor nozzle 19 together with the suction pipe 18 and the free end of the suction hose 17 on the underside of the lower housing part 11.

An additional simplification of the handling of the vacuum cleaner 10 is achieved by the upper housing part 12 having on its upper side next to the hand grip 28 a circular ring-shaped socket 88 into which the free end of the suction hose 17 is insertable for storage after it has been separated from the suction pipe 18. The socket 88 thus serves to hold the free end of the suction hose 17 during its storage. One end of the suction hose can therefore be secured to the suction inlet 15 of the dirt collection container 14, and the other end of the suction hose can be secured on the upper side of the upper housing part 12 by means of the socket 88 after the suction hose has been led around the outside of the upper housing part 12 and clamped in place on the upper housing part 12 by means of the hooks 53 and 54. The suction pipe 18 can be secured together with the floor nozzle 19 to the first holding device 81 on the side of the lower housing part.

From the foregoing it will be apparent that the channel-shaped cable receptacle 22 for the supply cable 21 is arranged above the hose mount 51 which, in turn, is positioned above the recesses 47, 48 and 49. It has been found that this enables particularly easy handling of the vacuum cleaner. In particular, the supply cable 21 can be easily placed in the cable receptacle 22 without the user being impeded by the suction hose 17. The suction hose 17, in turn, can be clamped in the hose mount 51 for storage and easily removed from the hose mount 51 when the vacuum cleaner 10 is put into operation without being impeded by the supply cable 21. There is practically no danger of supply cable 21 and suction hose 17 becoming entangled. Independently of the positioning of the supply cable 21 and the suction hose 17, the user can clamp accessory parts in the form of a crevice nozzle, an upholstery nozzle and a radiator brush in the recesses 47, 48 and 49, with these recesses being directly accessible to him. The recesses 47, 48 and 49 are formed in combination with the hose mount 51 by the one-piece plastic molding 45 which is placed on the side of the lower housing part 11. This imparts a high mechanical load-bearing capacity to the hose mount 51, and the vacuum cleaner 10 can be easily assembled. The recesses 47, 48 and 49 are predefined by the plastic molding 45, so that the design of the lower housing part 11 is unaffected thereby. The lower housing part 11 can therefore have a smooth surface on the inside, so that the dirt collection container 14 can be easily cleaned.

The invention claimed is:

1. Vacuum cleaner comprising:

a lower housing part, on which wheels are mounted for moving the vacuum cleaner along a floor surface, and which forms a dirt collection container with a suction inlet to which a suction hose is connectable;

an upper housing part which is mountable on the lower housing part and accommodates an electrically drivable suction unit;

an electric supply cable for connecting the suction unit to an electrical voltage source;

a cable receptacle for storing the supply cable; and a hose mount for storing the suction hose;

wherein:

the cable receptacle surrounds the upper housing part on an outside in a circumferential direction, the hose mount is arranged below the cable receptacle, and the hose mount comprises two L-shaped hooks, each of which has a first leg which projects from the lower housing part and an adjoining second leg extending up to a level of and at a distance from the upper housing part.

2. Vacuum cleaner in accordance with claim 1, wherein the cable receptacle is of channel-shaped configuration and has an opening for passing through an end area of the supply cable into an interior of the upper housing part.

3. Vacuum cleaner in accordance with claim 1, wherein the hose mount is secured to an outer side of the lower housing part.

4. Vacuum cleaner in accordance with claim 1, wherein the hose mount is secured to a side of the lower housing part that faces away from the suction inlet.

5. Vacuum cleaner in accordance with claim 1, wherein the hose mount is arranged at a greater distance from the floor surface than the suction inlet.

6. Vacuum cleaner in accordance with claim 1, wherein the two L-shaped hooks which are aligned parallel to each other.

7. Vacuum cleaner comprising:

a lower housing part, on which wheels are mounted for moving the vacuum cleaner along a floor surface, and which forms a dirt collection container with a suction inlet to which a suction hose is connectable;

an upper housing part which is mountable on the lower housing part and accommodates an electrically drivable suction unit;

an electric supply cable for connecting the suction unit to an electrical voltage source;

a cable receptacle for storing the supply cable; and a hose mount for storing the suction hose;

wherein:

the cable receptacle surrounds the upper housing part on an outside in a circumferential direction, the hose mount is arranged below the cable receptacle, and the hose mount comprises two L-shaped hooks which are rigidly connected to each other by a cross member.

8. Vacuum cleaner in accordance with claim 7, wherein the cross member forms a supporting surface for supporting the suction hose.

9. Vacuum cleaner in accordance with claim 1, wherein the hose mount has on an outer side facing away from the upper housing part at least one set-down surface for setting the vacuum cleaner down on the floor surface in a storage position tilted through 90° in relation to an operating position of the vacuum cleaner.

10. Vacuum cleaner in accordance with claim 1, wherein at least one recess is arranged below the hose mount for storing at least one accessory part of the vacuum cleaner.

11. Vacuum cleaner in accordance with claim 10, wherein the at least one recess is formed in a plastic molding which is secured to an outer side of the lower housing part.

12. Vacuum cleaner in accordance with claim 11, wherein the plastic molding forms the at least one recess and the hose mount.

13. Vacuum cleaner in accordance with claim 1, further comprising a first and a second holding device for a floor nozzle which is connectable to the suction hose, the first holding device being arranged on a side wall of the lower housing part and the second holding device being arranged on a bottom wall of the lower housing part.

* * * * *